US005348055A

United States Patent [19]

Kramer

[11] Patent Number: 5,348,055

[45] Date of Patent: Sep. 20, 1994

[54] HEDDLE EYELET STRUCTURE

[75] Inventor: Charles F. Kramer, Greenville, S.C.

[73] Assignee: Steel Heddle Mfg. Co., Greenville, S.C.

[21] Appl. No.: 57,578

[22] Filed: May 6, 1993

[51] Int. Cl.[5] ..... D03C 9/04

[52] U.S. Cl. ..... 139/93

[58] Field of Search ..... 140/72; 242/51; 139/95, 139/52, 93

[56] References Cited

U.S. PATENT DOCUMENTS

| | | | |
|---|---|---|---|
| 2,249,390 | 7/1941 | Mahler | 139/93 |
| 3,049,151 | 8/1962 | McFetters | 139/93 |
| 3,590,880 | 7/1971 | Kathriner | 139/93 X |
| 5,092,370 | 3/1992 | Anderson | 139/93 |

FOREIGN PATENT DOCUMENTS

| | | | |
|---|---|---|---|
| 330781 | 6/1958 | Switzerland | 139/93 |

*Primary Examiner*—Andrew M. Falik
*Attorney, Agent, or Firm*—Dority & Manning

[57] ABSTRACT

A heddle for use in a weaving loom has an end-loop configured at one or both ends thereof for mounting on a slide bar of a harness frame. The heddle includes a substantially flat width section which is substantially parallel to the warp threads in a weaving loom when the heddle is mounted on the slide bar of a harness frame within the loom. An eye is disposed through the width section and is defined by a first side segment and a second side segment. The side segments are oppositely laterally disposed a predetermined distance relative to the width section so that a plane through the eye forms a predetermined angle with the plane of the width section. The side segments are also formed so that a plane through each of the side segments also forms a predetermined angle with the plane of the eye. In a preferred embodiment, the side segments are formed parallel to the width section.

12 Claims, 4 Drawing Sheets

HEDDLE EYELET STRUCTURE

BACKGROUND OF THE INVENTION

The most common heddle for use in weaving looms consists of a relatively thin flat strip of metal, such as steel, which has an opening or eye intermediate of the ends of the heddle. As is commonly understood, a single warp thread or yarn passes through the eye of the heddle. The heddles are typically mounted on a slide bar of a harness frame within the loom and, in this manner, the width or flat strip side of the heddle is parallel to the warp threads. The eye of the heddle is typically rectangular with fully rounded ends or squared ends with small corner radii to minimize chafing of the warp yarn passing through the eye. It is also known that the edges and corners of the eye should be well polished to avoid damaging or impeding the movement of the warp thread.

In an ideal configuration, the eye of the heddle should not bind or chafe the warp thread passing therethrough nor crowd or contact the adjacent warp threads controlled by heddles bounded in adjacent harness frames in the set during the shed change reciprocating and opposite up/down movements of the harness frames and heddles. However, conventional heddles do not obtain this ideal situation.

Since the heddle is mounted in the frame with its width parallel to the warp threads, the common practice in the art is to twist the center portion of the heddle about its longitudinal axis so as to open or cant the eye for passage of the warp yarn therethrough. However, with the conventional heddles, if the center portion of the strip is twisted sufficiently to allow the warp yarn to pass therethrough without binding or chafing in the eye itself, the twisted portion of the heddle tends to interfere and rub against adjacent warp threads. Alternatively, if the center portion is twisted to a lesser degree so as not to interfere with adjacent yarns, the eye does not present a straight passage for the warp yarn, which tends to bind within the eye itself. Thus, the conventional heddles have not been able to eliminate friction and interference both within the eye and with adjacent warp threads. Applicant's present invention addresses these deficiencies in the conventional heddles and marks a significant improvement in the art.

OBJECTS AND SUMMARY OF THE INVENTION

It is a principle object of the present invention to provide a heddle having an improved eye structure which minimizes the interference and friction between the eye and a warp thread passing therethrough, as well as between the heddle and adjacent warp threads.

It is also an object of the present invention to provide a method for forming a heddle so that there is minimum interference between the eye of the heddle and a warp yarn passing therethrough and between the heddle and adjacent warp yarns.

And yet another object of the present invention is to provide a method for forming the eye of a conventional heddle to maximize the clearance for a warp yarn therethrough and to minimize the outside width of the eye to reduce crowding of adjacent warp yarns.

A further object of the present invention is to provide a heddle having an eye with a width that has been maximized to obtain a uniform and full opening profile along the entire longitudinal length of the eye so as to avoid pinching and distorting of the yarn at the extreme ends of the eye.

It is also an object of the present invention to provide a method for maximizing the advantage of a heddle having an improved eye structure by tailoring the dimensions of the eye according to a particular size yarn.

Additional objects and advantages of the invention will be set forth in part in the description which follows, and in part will be obvious from the description or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a heddle is provided for use in a weaving loom. The heddle has an end-loop configured at one or both ends thereof for mounting the heddle on a slide bar of a harness frame, as is commonly understood. The heddle comprises a substantially flat width section which is substantially parallel to the warp threads in the loom when the heddle is mounted on the slide bar of the harness frame. An eye is disposed through the width section intermediate the ends of the heddle. The eye is defined by a first side segment and a second side segment. The side segments are oppositely laterally disposed a predetermined distance from the width section so that the plane of the eye forms a predetermined angle with the plane of the width section. The side segments are formed so that a plane through each of the side segments also forms a predetermined angle with the plane of the eye.

In a preferred embodiment of the present heddle, the side segments are formed substantially parallel to the width section so that the angle formed between the plane through each side segment and the plane of the eye is substantially equal to the angle formed between the plane of the eye and the width section. In a still further preferred embodiment, the side segments comprise substantially parallel portions of the width section. The degree of the angle of the eye relative to the width section is thereby determined by the degree of lateral displacement between the side segments. In other words, the larger the lateral displacement between the side segments, the greater the angle. It is preferred that the angle be of a sufficient degree so that a warp yarn may pass substantially straight through the eye without contacting either of the side segments. It is preferred to maximize the lateral displacement between the parallel side portions or segments to such an extent that the lateral displacement is greatest without the parallel portions contacting adjacent warp yarns in the loom when the heddle is hung therein.

In a still further preferred embodiment, the configuration of the eye, particularly the lateral displacement between the side segments, is particularly tailored according to the denier of the warp yarn the heddle is to be used with. For example, for a warp yarn of 150 denier, it is preferred that the lateral displacement between the side segments be approximately 0.36 millimeters. Likewise, for a 75 denier warp yarn, the lateral displacement is approximately 0.27 millimeters. For a warp yarn having a denier of 50, the lateral displacement between the side segments is approximately 0.23 millimeters.

The side segments may be laterally and oppositely displaced from the flat width section in any manner of means but, in a preferred embodiment, the side segments are displaced by being twisted in a first direction relative to the width section and subsequently being twisted in a second opposite direction so as to be substantially parallel to the width section.

The eye of the present invention may comprise any suitable configuration and, in one preferred embodiment, is substantially rectangular in shape with substantially fully rounded ends. Likewise, the eye may be substantially rectangular in shape having substantially squared ends with cornered radii.

The end-loop configurations of the present heddle may comprise any conventional known configuration, such as a C-shaped end-loop formed in one or both ends thereof, or a J-shaped end-loop formed in one or both ends thereof, or an O-shaped end-loop formed in one or both ends thereof.

In further accordance with the purposes and objects of the present invention, a method is provided for forming an eye in a heddle so as to minimize the friction of the heddle with a warp yarn passing therethrough and with adjacent warp yarns. The method of the present invention includes the step of defining the eye through the flat thin width section intermediate the ends of the heddle so that the eye is essentially defined by side segments of the width section. The portion of the width section having the eye defined therethrough is then canted so that the plane of the eye between the side segments forms a predetermined angle with the plane of the uncanted width section. The side segments of the canted portion are then formed so that a plane through each segment forms an angle with the plane of the eye. It is preferred to form the side segments parallel to each other and to the uncanted width section of the heddle. In this manner, the angle between the plane of the segments and the plane of the eye is essentially equal to the angle between the plane of the eye and the uncanted width section.

In a preferred embodiment of the present method, the canting of the width section is done by twisting the width section having the eye defined therethrough in a first direction. The step of forming the side segments parallel to the width section is then accomplished by twisting the side segments in a second opposite direction until the segments are parallel to the untwisted section of the heddle. It is preferred to maximize the clearance for a warp yarn through the eye of the heddle by canting the width section having the eye defined therethrough to a degree so that when the side segments are formed parallel, they lie just beside and parallel to adjacent warp yarns when thee heddle is hung from the harness frame in the loom.

The accompanying drawings, which are incorporated in and constitute a part of the specification, illustrate embodiments of the invention and, together with the description, serve to explain the principles of the invention.

DESCRIPTION OF THE PREFERRED EMBODIMENTS

Figure 1:
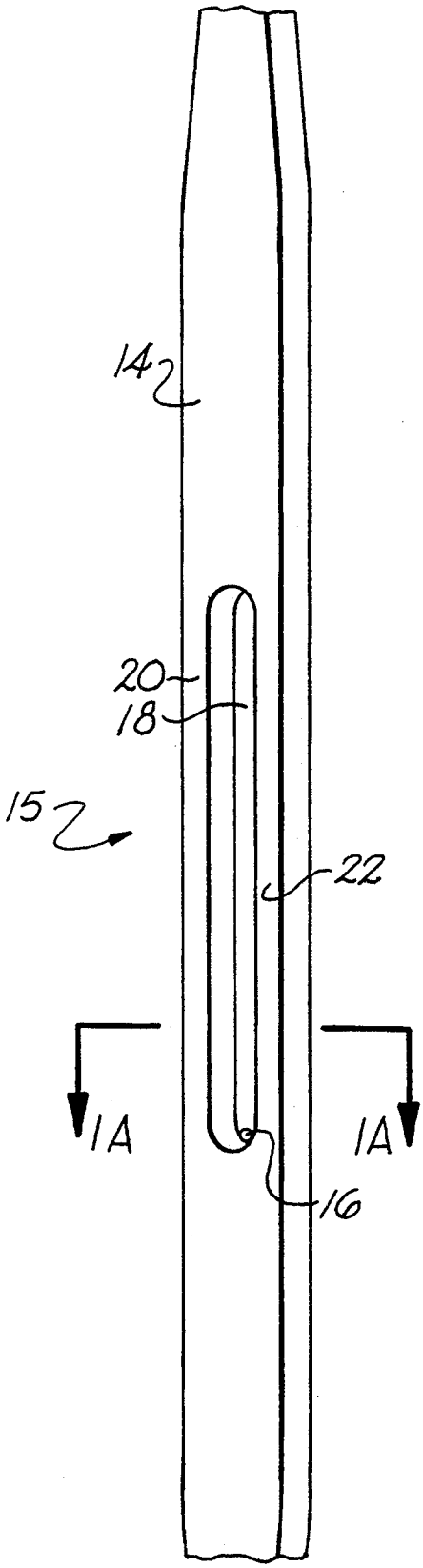
Fig. 1 PRIOR ART
FIG. 1 is a perspective partial view of a prior art heddle particularly illustrating the twisted central portion of the heddle having the eye defined therethrough.

Reference will now be made in detail to the presently preferred embodiments of the invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. The numbering of components in the drawings is consistent throughout the application, with the same components having the same number in each of the drawings.

Figure 1A:
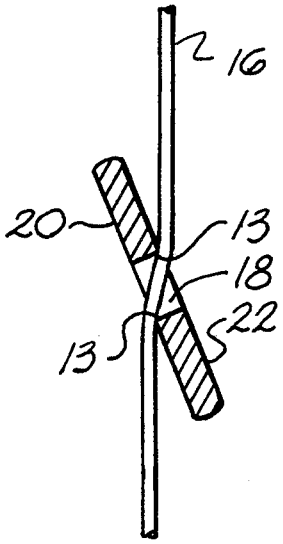
Fig. 1A PRIOR ART
FIG. 1*a* is a view of the apparatus of FIG. 1 taken along the lines indicated in FIG. 1.
Figure 2:
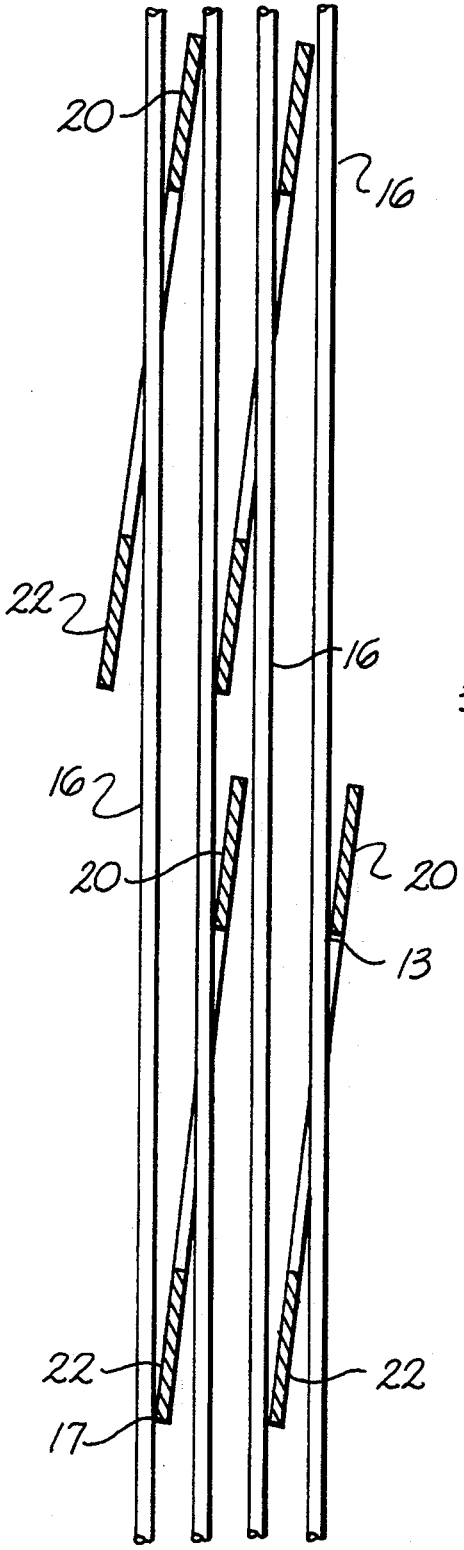
Fig. 2 PRIOR ART
FIG. 2 is a top view of prior art heddles shown as they would be oriented in a harness frame and particularly illustrates the path of the warp yarns through the heddle eyes.

FIGS. 1, 1*a*, and 2 illustrate prior art heddles of the type formed of relatively thin flat metal strips. The figures particularly illustrate the eye configuration 18 of the conventional heddles. Because the conventional heddles are mounted in the harness frame with their width or flat section 14 parallel to warp threads 16, it has been the common practice to twist the center portion 15 of the heddle about its longitudinal axis to open eye 18 for passage of warp yarns 16 therethrough. However, FIGS. 1*a* and 2 particularly illustrate the problems with the conventional heddles. Since the entire width section 14 of the center portion of the heddle is twisted so as to open eye 18 to the warp thread 16, the clearance or degree of openness of eye 18 is limited. FIG. 2 particularly illustrates the undesirable conditions that are created when the central portion 15 of the prior art devices is twisted so that warp yarns 16 pass substantially straight through the eyes 18 of the heddles. Generally, at least one of the edges of the heddle will rub or interfere with adjacent warp yarns. This is illustrated at point 17 of FIG. 2. On the other hand, of the central portion 15 is twisted so as not to interfere with adjacent warp threads, then the degree of clearance through eye 18 for warp yarn 16 is restricted causing the warp yarn 16 to rub against the inner surfaces of the eye. This is particularly illustrated at points 13 of FIGS. 2 and 1*a*. FIG. 1*a* particularly illustrates the problem with insufficient twist of central portion 15 of the conventional heddles. The binding or chafing of the warp yarns 16 within eye 18 of the conventional heddle or interference with adjacent warp yarns, as illustrated in FIG. 2, is extremely detrimental to the weaving process, particularly if the chafing or rubbing causes the warp yarn to break.

Figure 3:
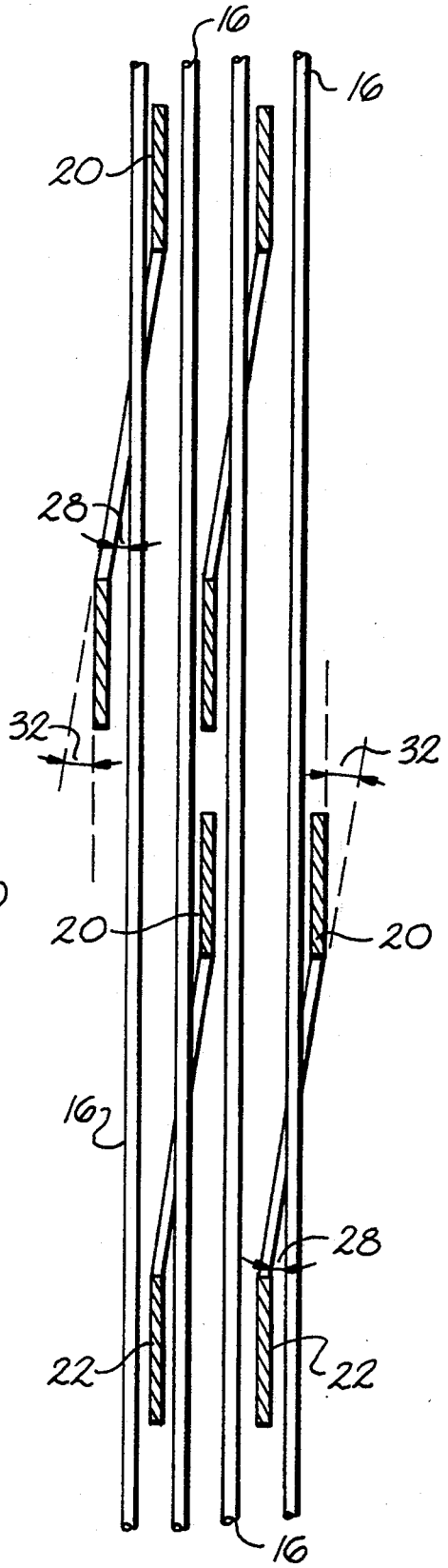
FIG. 3 is similar to FIG. 2 and illustrates the heddle eye configuration of the present invention when viewed from the top of the harness frame.
Figure 4:
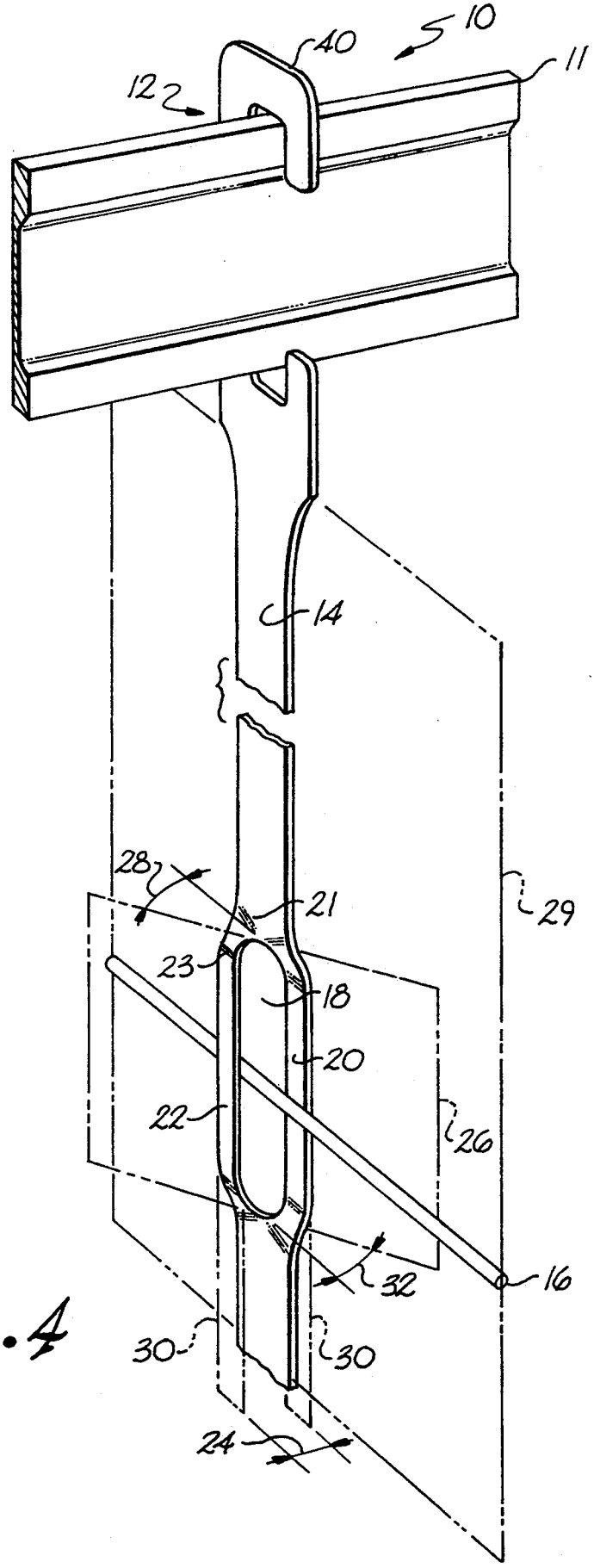
FIG. 4 is a diagrammatic and component view of the heddle according to the present invention particularly illustrating the planes defined by the components of the heddle.

The heddle according to the present invention is illustrated in FIGS. 3 through 5*a*. Heddle 10 has an end-loop configuration 12 at one or both ends thereof for mounting heddle 10 on slide bar 11 of a harness frame. This concept is generally well understood by those skilled in the art and requires no explanation. End-loop configuration 12 may comprise a conventional C-shaped loop, as shown in FIG. 4, or may comprise a J-shaped or other conventional configuration.

Heddle 10 further includes a body defined by a substantially flat width section 14. In the embodiment wherein heddle 10 is formed of a substantially thin strip of steel 40, width section 14 is the flat wide section of the steel strip 40. As is commonly understood, heddle 10 is mounted to slide bar 11 of the harness frame so that width section 14 is substantially parallel to the warp threads 16 in the loom. This concept is illustrated particularly in FIG. 4 and generally in FIG. 3.

Heddle 10 further includes eye 18 disposed through width section 14 between the ends of heddle 10. Eye 18 is preferably formed by first longitudinal side segment 20 and second longitudinal side segment 22. In the embodiment wherein heddle 10 is formed of steel strip 40, segments 20 and 22 comprise essentially portions of steel strip 40. In other words, eye 18 is initially formed in strip 40 by cutting out an interior section of width portion 14.

Figure 5:
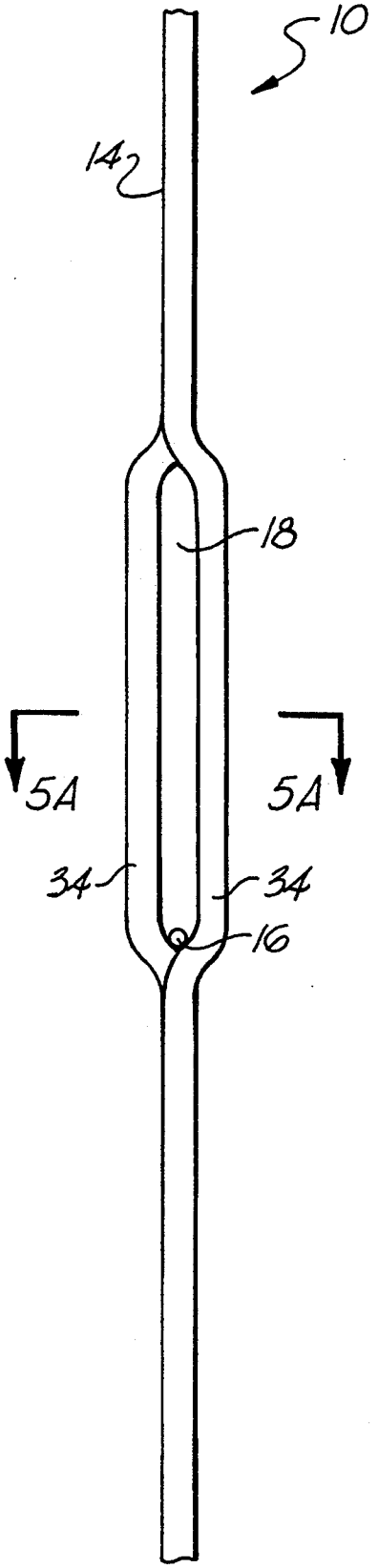
FIG. 5 is a component view of the heddle according to the present invention particularly illustrating the eye formed by the side segments of the heddle.
Figure 5A:
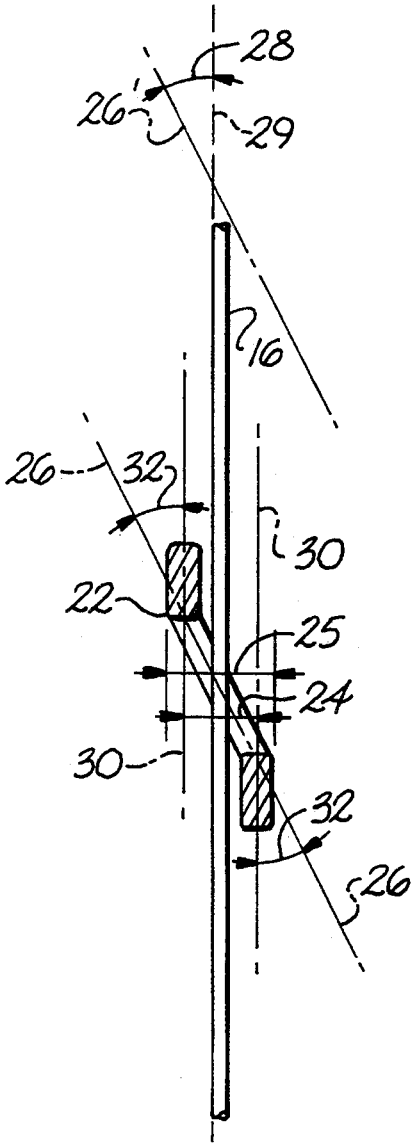
FIG. 5*a* is a view of the apparatus of FIG. 5 taken along the lines indicated in FIG. 5.

According to the present invention, segments 20 and 22 are oppositely laterally disposed a predetermined distance 24 from width section 14 so that the plane 26 of eye 18 forms a predetermined angle 28 with the longitudinal plane 29 of the width section 14 or, in essence, intersects plane 29. This concept is particularly illustrated in FIG. 4. As can be seen in the figure, plane 29 essentially is the plane of the overall heddle and passes substantially through width section 14. As mentioned, heddle 10 is hung on bar 11 so that plane 29 is substantially parallel to warp yarn 16 passing through eye 18. Distance 24 represents the total displacement between segments 22 and 20. It should be understood, that it is preferred that segments 20 and 22 be oppositely displaced from plane 29 an equal distance so that each contributes equally to displacement 24. Segments 20 and 22 are oppositely laterally disposed from width section 14 to create a degree a clearance of eye 18. In other words, if sections 20 and 22 were not oppositely disposed, plane 26 of eye 18 would be the same as plane 29 of width section 14. FIG. 5*a* particularly illustrates the angular relationship between plane 29 of the width section and plane 26 of the eye. Plane 26 is clearly the plane running through the eye and indicates the orientation of the eye. As indicated at the top of FIG. 5*a* wherein plane 26' is parallel to plane 26, the plane of eye 18 forms a non zero angle 28 with plane 29. Plane 29 is the plane of width section 14 and also warp yarn 16. The opposite lateral displacement of sides 20 and 22 is clearly illustrated in FIG. 5*a* as generating displacement distance 24. Angle 28 between the plane of the eye and the plane of the width section is also clearly indicated in FIG. 3.

Side segments 20 and 22 are then formed or fabricated so that a plane 30 through each side segment 20 and 22 forms a predetermined angle 32 with plane 26 of eye 18. This angular relationship between planes 30 of the segments and plane 26 of the eye is illustrated in FIG. 4 and particularly in FIG. 5*a*. Referring to FIG. 5*a*, each segment 22 and 20 has a plane 30 therethrough. Segments 22 and 20 are formed so that plane 30 forms a predetermined angle 32 with the plane of the eye 26.

In a preferred embodiment of the invention, segments 20 and 22 are formed so that they are essentially parallel with width section 14. This concept is particularly illustrated in FIG. 5 where it can be seen that plane 30 is parallel to plane 29. In this manner, angle 32 formed between plane 30 and plane 26 of eye 18 is essentially equal to angle 28 formed between plane of the eye 26 and plane 29 of the width section. However, this is not a limitation of the invention. Segments 20 and 22 are formed so as to form angle 32 so that lateral distance 24 between the segments can be maximized without the segments interfering with adjacent warp yarns. This concept is particularly illustrated in FIG. 3 as compared to the prior art device of FIG. 2. In the embodiment of FIG. 5*a*, the segments 20 and 22 are shown formed so as to be parallel with width section 14. The parallel configuration is preferred in that it maximizes lateral distance 24 while minimizing the chance of interference with adjacent warp yarns.

The advantages of the present invention are particularly illustrated in FIG. 3 where it can be seen that warp yarns 16 may pass substantially straight through eye 18 of the heddles without interfering or touching with either side segment 20 or 22. Additionally, segments 20 or 22 do not interfere with adjacent warp yarns but essentially lie just next to and parallel to the adjacent warp yarns 16.

Applicant has determined that in preferred embodiments of the heddle according to the invention, the configuration of the eye is effectively determined according to the denier of the warp yarn 16 for which the eye is to be used. In the case of a 150 denier warp yarn, lateral displacement distance 24 between side segments 20 and 22 is preferably approximately 0.36 millimeters. Distance 25 shown in FIG. 5*a* between the outermost edges of segments 20 and 22 will depend on the thickness of width section 14. In the case of a 75 denier warp yarn, the lateral displacement between the side segments is approximately 0.27 millimeters. Likewise, in the case of a 50 denier warp yarn, the lateral displacement between the side segments is approximately 0.23 millimeters. It is, however, within the scope and spirit of the invention to achieve the advantages of the invention with other displacement distances as may be determined by practice of the invention.

Segments 20 and 22 of the present heddle may be formed in one preferred manner by being twisted in a first direction 21 relative to width section 14 so as to achieve lateral displacement distance 24. Subsequently, the segments are twisted in a second opposite direction 23 so as to form the predetermined angle between planes 30 and 26. This is merely one preferred manner of forming segments 20 and 22. Alternately, the segments may be formed by appropriate bends, molding, or any other convenient means for forming the eye configuration according to the invention. The general shape of the eye is also not a limiting factor in the present invention. For example, the eye may be substantially rectangular in shape and have substantially fully rounded ends as shown in FIGS. 4 and 5. In an alternative embodiment, the eye may be substantially rectangular in shape and have squared ends with a corner radii defined therein as shown by dashed lines in FIG. 4.

In further accordance with the purposes of the invention, a method is provided for forming the apparatus according to the invention. The method includes defining the eye 18 through the flat thin width section 14 of a heddle so that the eye is essentially defined by side segments 22 of the width section 14, as discussed above. The width section 14 having the eye 18 defined therethrough is then canted so that the plane of the eye forms a predetermined angle with the plane of the uncanted width section. Finally, the side segments 20 and 22 of the canted portion is formed so that each segment forms an angle with the plane of the eye, as shown in FIG. 4. The method may include forming the side segments parallel to each other and to the uncanted width section. In this manner, the angle between the plane of the segments and the plane of the eye is essentially equal to the angle between the plane of the eye and the uncanted width section. The canting of the width section 14 may be done by twisting the width section in a first direction and then forming the side segments parallel to the width section by twisting the side segments in a second opposite direction. The clearance for warp yarn 16 through the eye is maximized by canting the width section having the eye defined therethrough to such a degree that when the side segments are formed parallel they lie just beside and parallel to the adjacent warp yarns, as shown particularly in FIG. 3.

It will be apparent to those skilled in the art that various modifications and variations can be made in the apparatus and method of the invention without departing from the scope or spirit of the invention. For example, the eye according to the invention may be formed through any conventional means and also comprise any conventional shape. Furthermore the heddle according to the invention may comprise any manner of end-loop configurations at one or both ends thereof. Thus, it is intended that the present invention cover the modifications and variations of the invention provided they come within the scope of the appended claims and their equivalents.

What is claimed is:

1. A heddle for use in a weaving loom, the heddle having an end-loop configured at one or both ends thereof for mounting said heddle on a slide bar of a harness frame, said heddle comprising:

a substantially flat width section, said width section configured to be substantially parallel to the warp threads in a loom upon said heddle being mounted on the slide bar of the harness frame;

an eye disposed through said width section intermediate the ends of said heddle, said eye defined by a first side segment and a second side segment, said segments being oppositely laterally disposed in different but parallel planes a predetermined distance from said width section so that a plane through said eye forms a predetermined non zero angle with a plane through said width section; and wherein said side segments are formed so that a plane through each said side segment forms a predetermined angle with the plane of said eye which is substantially equal to said non zero angle.

2. The heddle as in claim 1, wherein said side segments are formed substantially parallel to said width section so that the angle between the plane through each said side segment and the plane of said eye is substantially equal to the angle formed between the plane of said eye and said width section.

3. The heddle as in claim 2, wherein said side segments comprise substantially parallel portions of said width section, the degree of the angle of said eye relative said width section being determined by the degree of lateral displacement between said side segments and of a sufficient degree so that a warp yarn may pass substantially straight through said eye without contacting either said side segment.

4. The heddle as in claim 3, wherein the lateral displacement between said parallel portions is maximized to an extent that said parallel portions do not contact adjacent warp yarns in the loom.

5. The heddle as in claim 3, wherein said side segments are laterally displaced by being twisted in a first direction relative said width section, said side segments being twisted in a second opposite direction so as to be substantially parallel to said width section and a warp yarn passing through said eye.

6. The heddle as in claim 4, wherein said heddle is configured for use with a warp yarn of 150 denier, the lateral displacement between said side segments being approximately 0.36 millimeters.

7. The heddle as in claim 4, wherein said heddle is configured for use with a warp yarn of 75 denier, the lateral displacement between said side segments being approximately 0.27 millimeters.

8. The heddle as in claim 4, wherein said heddle is configured for use with a warp yarn of 50 denier, the lateral displacement between said side segments being approximately 0.23 millimeters.

9. The heddle as in claim 1, wherein said eye is substantially rectangular in shape with substantially fully rounded ends.

10. The heddle as in claim 1, wherein said eye is substantially rectangular in shape with substantially squared ends having a corner radii.

11. A weaving loom heddle, comprising:

a body of a relatively thin flat strip having a length lying in a longitudinal plane and configured in one or both ends thereof for mounting on a heddle frame slide bar; and an eye defined through said body intermediate the ends thereof through which a warp yarn may pass, said eye formed by substantially parallel longitudinal segments which are oppositely laterally displaced in different but parallel planes a predetermined distance from said body so that a plane through said eye intersects said longitudinal plane through said body, said parallel segments being substantially parallel to the longitudinal plane of said body.

12. The heddle as in claim 11, wherein said predetermined lateral displacement of said parallel segments is maximized without said segments contacting adjacent warp yarns in the loom, said segments formed so as to lie just next to and parallel to adjacent warp yarns;

wherein the degree of clearance for a warp yarn through said eye is maximized without adversely contacting adjacent warp yarns in the loom by said parallel segments being laterally displaced so as to lie just next to and parallel to adjacent warp yarns.

* * * * *